US009512635B2

(12) United States Patent
Woo

(10) Patent No.: US 9,512,635 B2
(45) Date of Patent: Dec. 6, 2016

(54) KNOB STRUCTURE OF GLOVE BOX FOR VEHICLE

(71) Applicant: HYUNDAI MOBIS CO., LTD., Seoul (KR)

(72) Inventor: Jong Sun Woo, Yongin (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 169 days.

(21) Appl. No.: 14/477,786

(22) Filed: Sep. 4, 2014

(65) Prior Publication Data

US 2015/0123411 A1 May 7, 2015

(30) Foreign Application Priority Data

Nov. 5, 2013 (KR) ..... 10-2013-0133758

(51) Int. Cl.

| | |
|---|---|
| ***E05B 3/00*** | (2006.01) |
| ***E05B 1/00*** | (2006.01) |
| ***E05B 63/00*** | (2006.01) |
| ***E05B 83/30*** | (2014.01) |
| ***E05B 85/14*** | (2014.01) |

(52) U.S. Cl.

CPC ..... *E05B 3/00* (2013.01); *E05B 1/0007* (2013.01); *E05B 63/0065* (2013.01); *E05B 83/30* (2013.01); *E05B 85/14* (2013.01); *Y10S 292/37* (2013.01); *Y10S 292/63* (2013.01); *Y10T 292/57* (2015.04)

(58) Field of Classification Search

CPC .... Y10S 292/37; Y10S 292/31; Y10S 292/63; Y10T 292/57; Y10T 292/0841; Y10T 292/0845; Y10T 292/1014; Y10T 292/102; Y10T 292/0995; E05B 1/0007; E05B 3/00; E05B 63/0065; E05B 83/30; E05B 85/14

USPC ..... 292/336.3, 174, 38, 41, 138, 143, 292/DIG. 31, DIG. 37, DIG. 63

See application file for complete search history.

(56) References Cited

U.S. PATENT DOCUMENTS

| | | | | |
|---|---|---|---|---|
| 1,529,085 A * | 3/1925 | Preble | ..... | E05C 9/02 292/138 |
| 2,128,535 A * | 8/1938 | Lindstrom | ..... | E05B 7/00 292/173 |
| 3,785,686 A * | 1/1974 | Armstrong | ..... | E05C 1/14 292/336.3 |
| 6,513,354 B2 * | 2/2003 | Predd | ..... | E05B 13/002 292/336.3 |

(Continued)

FOREIGN PATENT DOCUMENTS

| | | |
|---|---|---|
| DE | 3818187 C1 * | 8/1989 |
| FR | 3024994 A1 * | 2/2016 |
| KR | 10-0568723 B1 | 3/2006 |

*Primary Examiner* — Kristina Fulton
*Assistant Examiner* — Christine M Mills

(57) ABSTRACT

A knob structure of a glove box for a vehicle according to an exemplary embodiment of the present invention includes: a push-type knob unit which is coupled to a glove box by a first fixed hinge, and operated by being pushed; a pull-type knob unit which is coupled to the glove box by a second fixed hinge, and operated by being pulled; and a rod unit which is connected to the push-type knob unit and the pull-type knob unit, and converts rotational motion by an operation of the push-type knob unit or the pull-type knob unit into rectilinear motion so as to open and close the glove box.

8 Claims, 4 Drawing Sheets

(56) References Cited

U.S. PATENT DOCUMENTS 7,455,333 B2 * 11/2008 Ookawara ..... E05B 83/30
292/34
8,191,935 B2 * 6/2012 Toppani ..... B60R 7/06
292/32

* cited by examiner

KNOB STRUCTURE OF GLOVE BOX FOR VEHICLE

CROSS-REFERENCE TO RELATED APPLICATIONS

This application claims priority to and the benefit of Korean Patent Application No. 10-2013-0133758 filed in the Korean Intellectual Property Office on Nov. 5, 2013, the entire contents of which are incorporated herein by reference.

TECHNICAL FIELD

The present invention relates to a knob structure of a glove box for a vehicle, and more particularly, to a knob structure of a glove box for a vehicle which has two types of knobs including a pull-type knob and a push-type knob on a glove box so as to improve convenience for a user.

BACKGROUND ART

Recently, as the supply of vehicles rapidly grows and comfort of vehicles is rapidly developed, various devices for convenience, which may provide convenience and comfort to occupants, are considered important as much as technical issues of vehicles such as traveling stability or ride quality.

As one of the devices for convenience provided in the vehicle, a glove box, which accommodates and stores items which a driver needs, is installed at an instrument panel positioned in front of a front passenger seat.

As a knob of the glove box for a vehicle, there currently are a push-type knob and a pull-type knob.

The two types of knobs of the glove box have advantages and disadvantages in terms of convenience for the user, respectively. The push-type knob has an advantage in that it is convenient for a male driver seated on the driver seat to operate the push-type knob while maintaining a direction in which the push-type knob is moved, but has a disadvantage in that an old or weak person or a female driver, who has a relatively short arm, needs to forcibly and deeply push the push-type knob in order to open the glove box. The pull-type knob has a problem in that the driver needs to inconveniently pull the pull-type knob while bending the hand on the basis of the front passenger seat.

LITERATURE OF RELATED ART

Korean Patent No. 10-0568723

SUMMARY OF THE INVENTION

The present invention has been made in an effort to provide a knob structure of a glove box for a vehicle which has two types of knobs including a pull-type knob and a push-type knob on a glove box so as to improve convenience for a user.

An exemplary embodiment of the present invention provides a knob structure of a glove box for a vehicle including: a push-type knob unit which is coupled to a glove box by a first fixed hinge, and operated by being pushed; a pull-type knob unit which is coupled to the glove box by a second fixed hinge, and operated by being pulled; and a rod unit which is connected to the push-type knob unit and the pull-type knob unit, and converts rotational motion by an operation of the push-type knob unit or the pull-type knob unit into rectilinear motion so as to open and close the glove box.

The push-type knob unit may have a first catching member which protrudes inward from one region of the push-type knob unit, the pull-type knob unit may have a second catching member which protrudes inward from one end of the pull-type knob unit, the rod unit may have a first supporting member and a second supporting member which are provided to protrude vertically from a rod that opens and closes the glove box by rectilinear motion, the first catching member may be connected with the first supporting member, and the second catching member may be connected with the second supporting member, such that the rotational motion by the operation of the push-type knob unit or the pull-type knob unit is converted into the rectilinear motion so as to open and close the glove box.

The push-type knob unit may have a projection that protrudes inward, and the knob structure may further include a first supporting hinge which is provided in the glove box, and comes into contact with the projection when the push-type knob unit is rotated, so as to control the rotation of the push-type knob unit.

The knob structure may further include a second supporting hinge which is provided between the first catching member and the second catching member, and comes into contact with the second catching member when the pull-type knob unit is rotated, so as to control the rotation of the pull-type knob.

The second catching member may have a 'ㄴ' shape, and the push-type knob unit may be moved inside a 'ㄷ'-shaped internal space by the 'ㄴ' shape when the push-type knob unit is operated, such that the push-type knob unit and the pull-type knob unit are separately operated.

The push-type knob unit and the pull-type knob unit may be positioned on the same plane, and surfaces where the push-type knob unit is in contact with the pull-type knob unit may be chamfered or rounded in order to prevent the push-type knob unit and the pull-type knob unit from interfering with each other when the push-type knob unit and the pull-type knob unit are operated.

When the first catching member may be connected with the first supporting member, and the second catching member may be connected with the second supporting member, elastic materials may be attached to contact surfaces so as to prevent abrasion or noise.

According to the dual structure of the glove box for a vehicle of the present invention, both the pull-type knob and the push-type knob are provided on the glove box, thereby improving convenience for a user.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
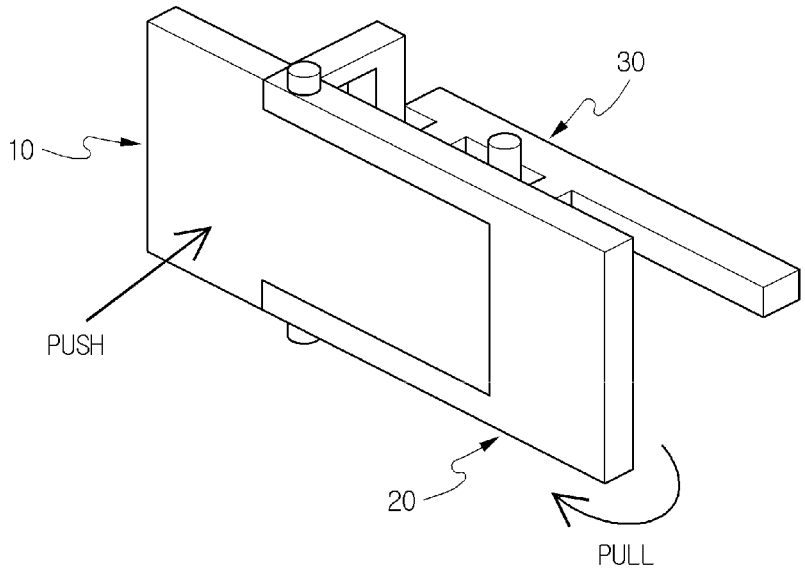
FIG. 1 is a front perspective view of a knob structure of a glove box for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, a knob structure of a glove box for a vehicle according to an exemplary embodiment of the present invention will be described in detail with reference to the accompanying drawings. First, in denoting reference numerals to constituent elements of respective drawings, it should be noted that the same elements will be designated by the same reference numerals although they are shown in different drawings. Hereinafter, an exemplary embodiment of the present invention will be described, but, of course, the technical spirit of the present invention is not restricted or limited thereto, but the exemplary embodiment of the present invention may be modified by a person with ordinary skill in the art to be variously performed.

Figure 2:
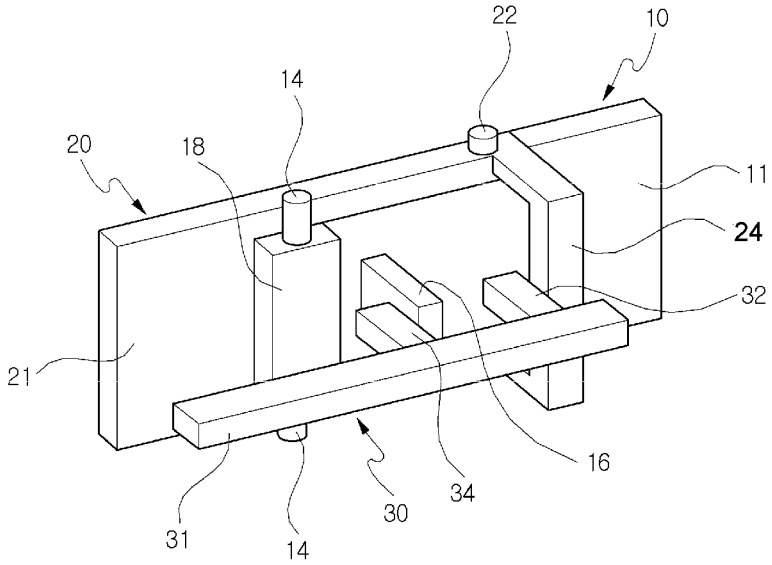
FIG. 2 is a rear perspective view of the knob structure of the glove box for a vehicle of FIG. 1.
Figure 3:
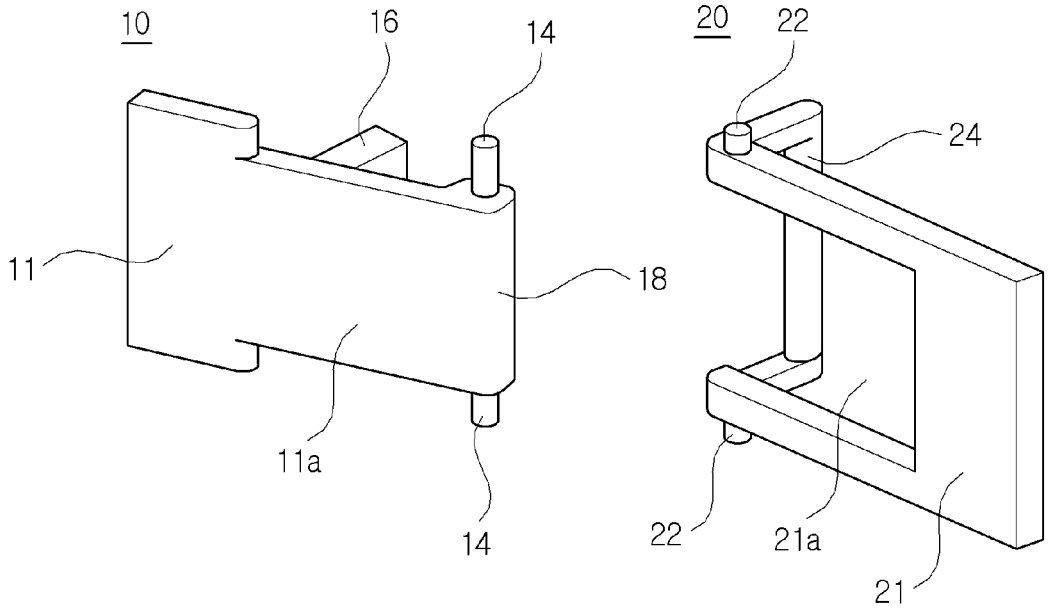
FIG. 3 is an exploded perspective view of a knob of the glove box for a vehicle of FIG. 1.

FIG. 1 is a front perspective view of a knob structure of a glove box for a vehicle according to an exemplary embodiment of the present invention, FIG. 2 is a rear perspective view of the knob structure of the glove box for a vehicle according to the exemplary embodiment of the present invention, and FIG. 3 is an exploded perspective view of a knob of the glove box for a vehicle according to the exemplary embodiment of the present invention.

Referring to FIGS. 1 to 3, a knob structure of a glove box for a vehicle according to an exemplary embodiment of the present invention includes a push-type knob unit 10, a pull-type knob unit 20, and a rod unit 30.

The push-type knob unit 10 includes a push-type knob cover 11, a first catching member 16 which protrudes from an inner surface of the push-type knob cover 11 in an approximately vertical direction, and first fixed hinges 14 which protrude at one end of the push-type knob cover 11 in upward and downward directions. The push-type knob cover 11 has a rectangular recessed portion 11*a*, and the first fixed hinges 14 are provided at an end of the recessed portion 11*a*. Since the first fixed hinges 14 need to be positioned inward from a front surface of the push-type knob cover 11, the first fixed hinges 14 may be positioned on upper and lower portions of a protruding portion 18 that protrudes inward from the end of the recessed portion 11*a*.

The pull-type knob unit 20 includes a pull-type knob cover 21 which has a recessed portion coupling space 21*a* to which the recessed portion 11*a* formed on the push-type knob cover 11 of the push-type knob unit 10 is coupled, a 'ㄷ'-shaped second catching member 24 which protrudes inward from one end of the pull-type knob cover 21, and second fixed hinges 22 which protrude on a connection portion between the pull-type knob cover 21 and the second catching member 24 in the upward and downward directions.

The rod unit 30 includes a rod 31 which opens and closes the glove box, and a first transmission member 34 and a second transmission member 32 which protrude from the rod 31 in a direction toward the knob of the glove box.

The pull-type knob cover 21 and the push-type knob cover 11 are coupled to each other, and positioned on the same plane. The aforementioned coupling shape of the pull-type knob cover 21 and the push-type knob cover 11 is merely an exemplary embodiment, and the coupling shape may be variously modified and used.

The push-type knob unit 10 and the pull-type knob unit 20 are separately coupled to the glove box (not illustrated), and the push-type knob unit 10 is moved in a 'ㄷ'-shaped internal space of the second catching member 24 when the push-type knob unit 10 is operated, such that the push-type knob unit 10 and the pull-type knob unit 20 are separately operated.

Since the push-type knob cover 11 and the pull-type knob cover 21 need not interfere with each other when the push-type knob cover 11 and the pull-type knob cover 21 are operated, surfaces where the push-type knob cover 11 comes into contact with the pull-type knob cover 21 are chamfered or rounded so that the push-type knob cover 11 and the pull-type knob cover 21 do not interfere with each other.

Figure 4:
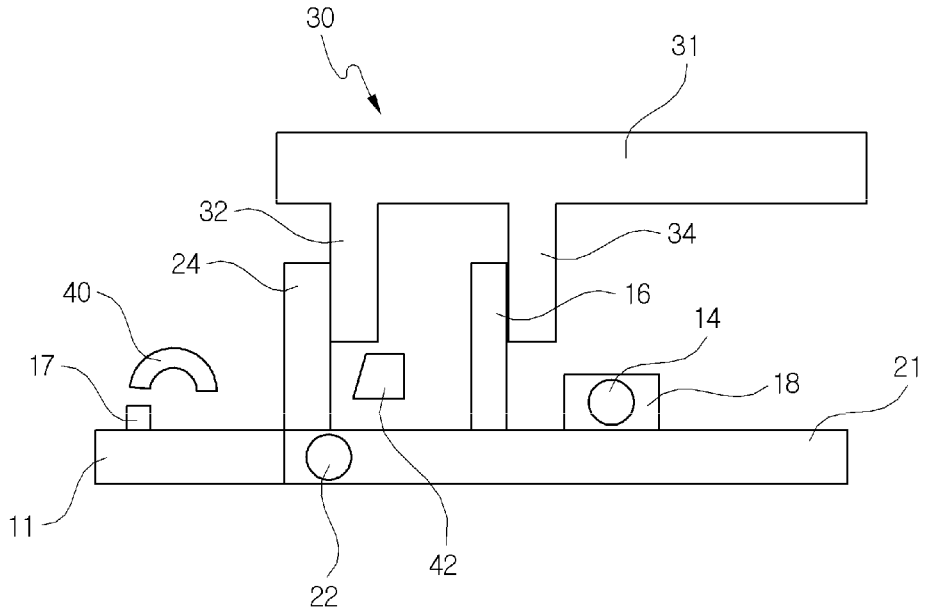
FIG. 4 is a top plan view illustrating a stationary state of the knob of the glove box for a vehicle of FIG. 1.

FIG. 4 is a top plan view of the knob structure of the glove box for a vehicle according to the exemplary embodiment of the present invention when the knob is not operated.

Referring to FIG. 4, the first catching member 16 of the push-type knob unit 10 is in contact with the first transmission member 34 of the rod unit 30, and the second catching member 24 of the pull-type knob unit 20 is in contact with the second transmission member 32 of the rod unit 30.

A projection 17, which protrudes from the inner surface of the push-type knob cover 11, is formed on the push-type knob cover 11, and a first supporting hinge 40, which limits a radius of rotation in a predetermined range when the push-type knob cover 11 is rotated, and a second supporting hinge 42, which is positioned in the internal space of the glove box between the first catching member 16 and the second catching member 24, and limits a radius of rotation in a predetermined range when the pull-type knob cover 21 is rotated, are formed in an internal space of the glove box.

The first and second catching members 16 and 24, and the first and second transmission members 34 and 32 are injection molded bodies, such that there is a risk that abrasion and noise may occur when these components are operated while being in contact with each other. Therefore, elastic materials may be coupled to contact surfaces so as to prevent the occurrence of abrasion and noise. In an exemplary embodiment, silicone, rubber or the like may be used as the elastic material.

Figure 5:
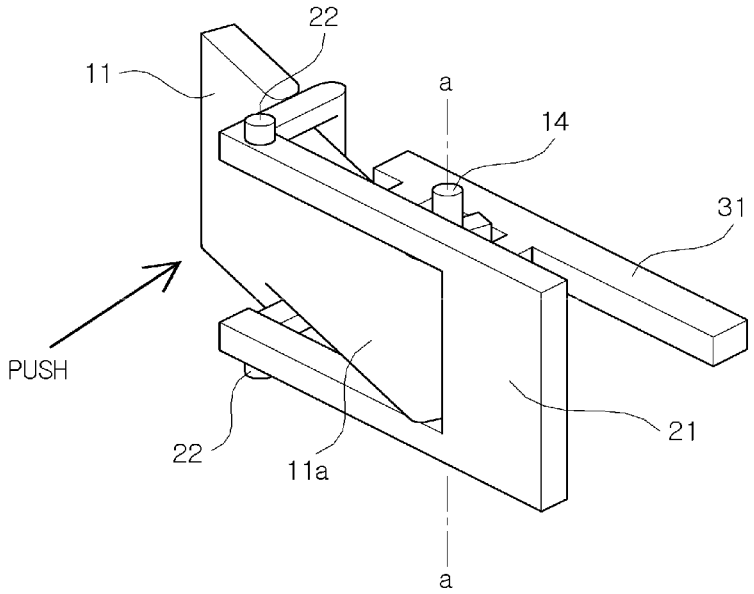
FIG. 5 is a front perspective view when a push-type knob of FIG. 1 is operated.
Figure 6:
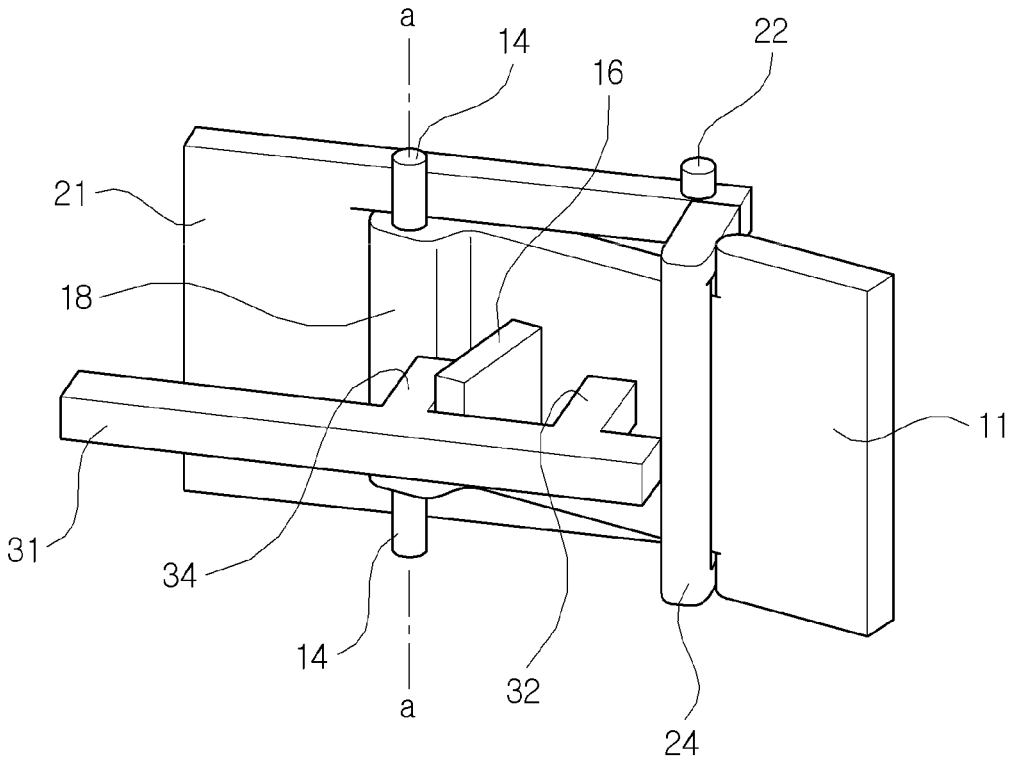
FIG. 6 is a rear perspective view when the push-type knob of FIG. 1 is operated.

FIG. 5 is a front perspective view when the push-type knob of the knob structure of the glove box for a vehicle according to the exemplary embodiment of the present invention is operated. FIG. 6 is a rear perspective view when the push-type knob of the knob structure of the glove box for a vehicle according to the exemplary embodiment of the present invention is operated.

Referring to FIGS. 5 and 6, when the push-type knob cover 11 is pushed inward when the push-type knob is operated, the first catching member 16 is rotated in a clockwise direction about a rotation axis a-a formed by coupling the first fixed hinges 14 and the glove box (not illustrated), and the first transmission member 34 of the rod unit 30, which is in contact with the first catching member 16, is rectilinearly moved such that the rod 31 opens the glove box. In this case, when the push-type knob cover 11 is rotated, the projection 17 formed on the push-type knob cover 11 comes into contact with the first supporting hinge 40 so as to adjust the rotation.

Figure 7:
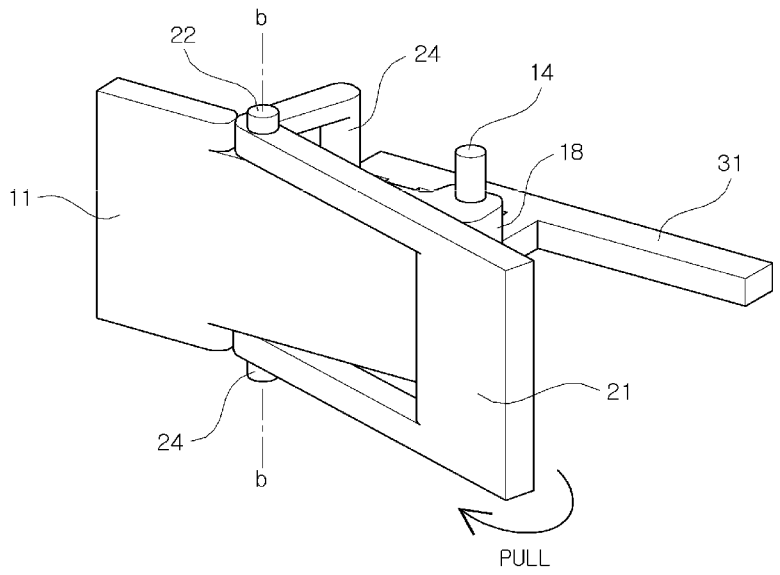
FIG. 7 is a front perspective view when a pull-type knob of FIG. 1 is operated.
Figure 8:
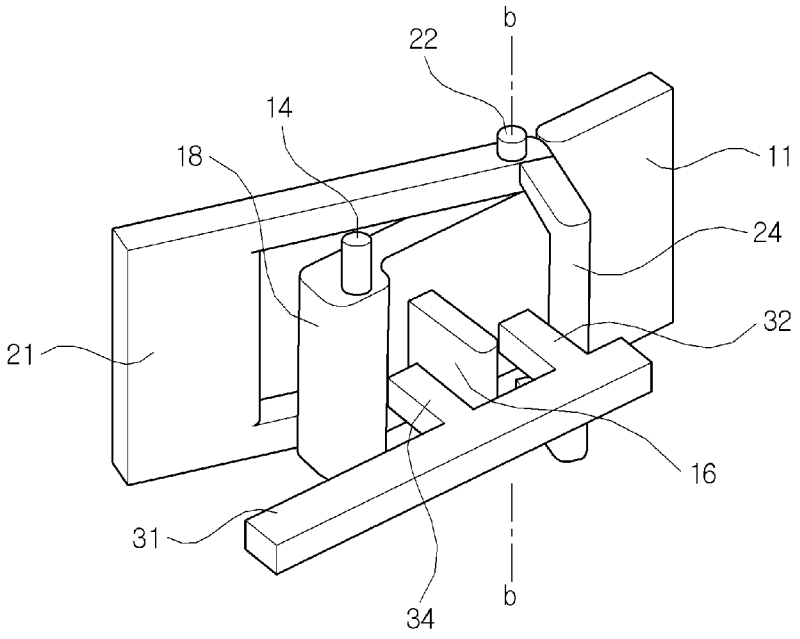
FIG. 8 is a rear perspective view when the pull-type knob of FIG. 1 is operated.

FIG. 7 is a front perspective view when the pull-type knob of the knob structure of the glove box for a vehicle according to the exemplary embodiment of the present invention is operated, and FIG. 8 is a rear perspective view when the pull-type knob of the knob structure of the glove box for a vehicle according to the exemplary embodiment of the present invention is operated.

Referring to FIGS. 7 and 8, when the pull-type knob cover 21 is pulled outward when the pull-type knob is operated, the second catching member 24 is rotated in a clockwise direction about a rotation axis b-b formed by coupling the second fixed hinge 22 and the glove box (not illustrated), and the second transmission member 32 of the rod unit 30, which is in contact with the second catching member 24, is rectilinearly moved such that the rod 31 opens the glove box (not illustrated). In this case, when the second catching member 24 is rotated, the second catching member 24 comes into contact with the second supporting hinge 42 so as to adjust the rotation.

As described above, according to the knob structure of the glove box for a vehicle of the present invention, both the pull-type knob and the push-type knob are provided on the glove box, such that the knob structure may be applied to vehicles being developed while maintaining the existing operation mechanism, thereby improving convenience for a user.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A knob structure of a glove box for a vehicle, comprising:

a push knob unit which is coupled to the glove box by a first fixed hinge, and operated by being pushed;

a pull knob unit which is coupled to the glove box by a second fixed hinge, and operated by being pulled; and a rod unit which is connected to the push-type knob unit and the pull knob unit, and which converts rotational motion by an operation of the push knob unit or the pull-type knob unit into rectilinear motion so as to open and close the glove box, wherein the push knob unit has a first catching member which protrudes inwardly from one region of the push knob unit, the pull knob unit has a second catching member which protrudes inwardly from one end of the pull knob unit, the rod unit has a first supporting member and a second supporting member which protrude vertically from a rod that opens and closes the glove box by the rectilinear motion, and wherein the first catching member is connected with the first supporting member, and the second catching member is connected with the second supporting member, such that the rotational motion by the operation of the push-type knob unit or the pull knob unit is converted into the rectilinear motion so as to open and close the glove box.

2. The knob structure of claim 1, wherein the push knob unit has a projection that protrudes inwardly, and the knob structure further includes a first supporting hinge which is disposed in the glove box, and comes into contact with the projection when the push knob unit is rotated, so as to control the rotation of the push-type knob unit.

3. The knob structure of claim 1, further comprising:

a second supporting hinge which is provided between the first catching member and the second catching member, and comes into contact with the second catching member when the pull knob unit is rotated, so as to control the rotation of the pull knob.

4. The knob structure of claim 1, wherein the second catching member has a '⊏' shape such that the second catching member includes first, second, and third members, the first and second members each extending in a first direction and being aligned in a second direction perpendicular to the first direction, the third member connecting end portions of the first and second members and extending in the second direction, and the push knob unit is moved in a space defined by the '⊏' shape when the push knob unit is operated, such that the push knob unit and the pull-type knob unit are separately operated.

5. The knob structure of claim 1, wherein surfaces of the push knob unit and the pull knob unit are present on the same plane, and surfaces where the push knob unit is in contact with the pull knob unit are chamfered or rounded in order to prevent the push knob unit and the pull knob unit from interfering with each other when the push knob unit and the pull knob unit are operated.

6. The knob structure of claim 1, wherein when the first catching member is connected with the first supporting member, and the second catching member is connected with the second supporting member, elastic materials are attached to contact surfaces so as to prevent abrasion or noise.

7. A knob structure comprising:

a push knob unit coupled to a glove box by a first fixed hinge and rotating about a rotational axis of the first fixed hinge in response to a first force exerted in a first direction;

a pull knob unit coupled to the glove box by a second fixed hinge and rotating about a rotational axis of the second fixed hinge in response to a second force exerted in a second direction, the second direction being substantially opposite to the first direction; and a rod unit coupled to the push knob unit and the pull knob unit and converting rotational motion of the push knob unit or the pull knob unit into rectilinear motion to open and close the glove box, wherein the push knob unit includes a first catching member that protrudes from a surface of the push knob unit in the first direction, wherein the rod unit includes a rod and a first supporting member, the first supporting member protruding from a surface of the rod in the second direction, and wherein the first catching member contacts the first supporting member when the push knob unit rotates about the rotational axis of the first fixed hinge.

8. The knob structure of claim 7, wherein the pull knob unit includes a second catching member that protrudes from a surface of the pull knob unit in the first direction, wherein the rod unit further includes a second supporting member, the second supporting member protruding from the surface of the rod in the second direction, and wherein the second catching member contacts the second supporting member when the pull knob unit rotates about the rotational axis of the second fixed hinge.

* * * * *